United States Patent [19]

Henningfield

[11] 4,193,142

[45] Mar. 18, 1980

[54] CHILD'S TOILET APPARATUS

[76] Inventor: Bernadine Henningfield, 326 W. Jefferson St., Elkhorn, Wis. 53121

[21] Appl. No.: 945,227

[22] Filed: Sep. 25, 1978

[51] Int. Cl.[2] ..... A47K 11/02

[52] U.S. Cl. ..... 4/141

[58] Field of Search ..... 4/134, 112, 141, 138, 4/119; D23/53

[56] References Cited

U.S. PATENT DOCUMENTS

| | | | |
|---|---|---|---|
| D. 168,463 | 12/1952 | La Hue | D23/53 |
| D. 197,949 | 4/1964 | Forsman | D23/53 |
| D. 201,427 | 6/1965 | Roe | D23/53 |
| D. 236,205 | 8/1975 | Powell | D23/53 |
| 1,289,650 | 12/1918 | Cappellari | 4/112 |
| 1,358,933 | 11/1920 | Collins | 4/134 |
| 2,559,027 | 7/1951 | Miralta-Seix | 4/141 |
| 2,662,229 | 12/1953 | Wenkstern | 4/135 |
| 2,719,305 | 10/1955 | La Hue | 4/134 |
| 2,776,438 | 1/1957 | Zeraffa | 4/134 |
| 3,176,319 | 4/1965 | Mackey | 4/134 |
| 3,657,745 | 4/1972 | Hickman | 4/141 |

*Primary Examiner*—Lenard A. Footland

*Attorney, Agent, or Firm*—Burmeister, York, Palmatier, Hamby & Jones

[57] ABSTRACT

A child's toilet apparatus includes an elongated body having an opening therein and being adapted to be straddled in a seated position by the user. A seat flange is disposed at the rim of the opening and is adapted to support the user seated thereon. The flange is inclined downardly from the rear thereof terminating at the front of the body at an upstanding pedestal portion. A recess in the pedestal portion communicates with and faces the opening. A pour spout communicates with the opening within the body and enables the apparatus to be emptied. A handle is disposed on the body to facilitate pouring operations.

4 Claims, 5 Drawing Figures

CHILD'S TOILET APPARATUS

The present invention relates in general to a child's toilet apparatus, and it more particularly relates to an apparatus which accommodates various different sizes of children in a comfortable manner.

Many different types and kinds of children's toilet apparatus have been employed. For example, reference may be made to the following U.S. Pat. Nos. Des. 168,463; Des. 197,949 and Des. 236,205. Also, reference may be made to U.S. Pat. Nos. 1,358,933; 2,559,027; 2,662,229; 2,719,305; 2,776,438; 3,176,319; and 3,657,745. While such devices may be satisfactory for some applications, it would be highly desirable to have a child's toilet apparatus, which could be adapted to accommodate comfortably different sizes of children or could be used by the same child as he or she grows in size. The apparatus should be light in weight and aesthetically pleasing in appearance. It should have little or no rough corners or edges which might otherwise tend to cause injury to the user. The apparatus should have no moving parts, which may become subject to failure or malfunction. Also, in order to make the apparatus more appealing to a young child, if desired, the child should be able to sit on the toilet apparatus, either facing the front or facing the rear thereof. In that same regard, the toilet apparatus should be entertaining for the user, while seated on the apparatus.

Therefore, the principal object of the present invention is to provide a new and improved child's toilet apparatus, which is adapted to seat comfortably various different sizes of children or the same child as he or she grows larger in size.

Another object of the present invention is to provide a new and improved child's toilet apparatus, which is intriguing for the child to use, and which is light in weight and does not provide a substantial risk of injury to the child, nor having any moving parts subject to failure.

Briefly, the above and further objects of the present invention are realized by providing a child's toilet apparatus, which includes an elongated body having on opening therein and being adapted to be straddled in a seated position by the user. A seat flange is disposed at the rim of the opening and is adapted to support the user in a seated position. The flange is inclined downwardly from the rear terminating at the front of the body in an upstanding pedestal portion to cause the user to be seated thereagainst, thereby enabling various different size children to be seated comfortably thereon, or the same child as he or she grows larger in size. As the child grows larger in size, the child automatically assumes the proper position relative to the pedestal since the child slides forwardly into engagement with the pedestal. A recess is provided in the pedestal portion communicating with and facing the opening. According to other features of the present invention, a convenient pour spout is provided and communicates with the opening within the body to facilitate cleaning thereof. A handle is disposed on the body for grasping by the hand to lift the apparatus during pouring operations or for carrying the unit. A convenient traylike recess is disposed in the upper surface of the pedestal to receive and support toys or other amusement devices to entertain the user while seated on the apparatus.

Other objects and advantages of the invention will become apparent to those skilled in the art by reference to the following detailed description with reference to the accompanying drawings, wherein.

Figure 1:
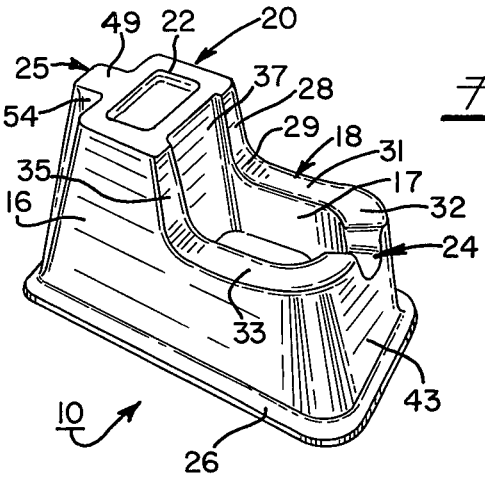
FIG. 1 is a pictorial view of the child's toilet apparatus, which is constructed in accordance with the present invention.
Figure 2:
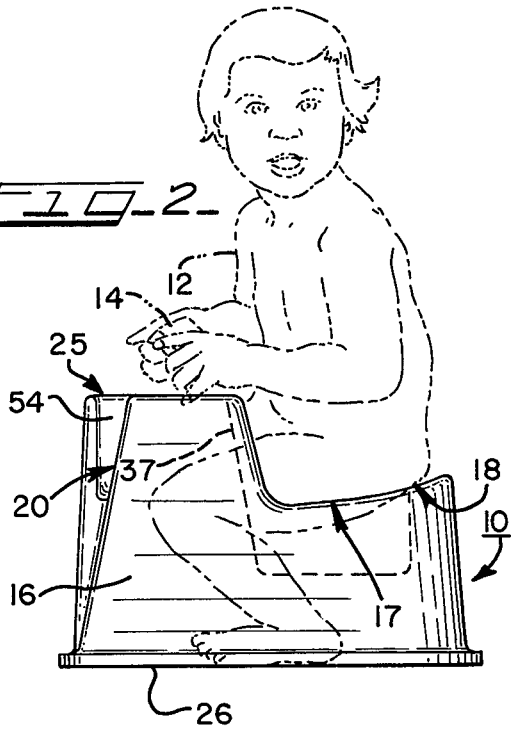
FIG. 2 is a left side elevational view of the apparatus of FIG. 1, illustrating its use.

Referring now to the drawings, and more particularly to FIG. 1 thereof, there is shown a child's toilet apparatus 10, which is constructed in accordance with the present invention, and which, as shown in FIG. 2 of the drawings, is adapted to enable a young child 12 to sit on and to straddle the apparatus 10, while being entertained with toys, such as the toy 14. The apparatus 10 generally comprises a body 16 having an opening or recess 17 in the upper surface thereof to serve as a receptacle, and a generally U-shaped seat flange 18 at the rim of the opening 17 to receive and support in a seated position the child 12. The flange 18 is inclined downwardly from the rear of the body 16 terminating at an upstanding pedestal portion 20 at the front of the body 16 to cause the user to be seated thereagainst. A recess 22 in the top of the pedestal portion 20 is adapted to receive and support the toy 14 and other articles of amusement for the user. At the rear of the body 16, a pour spout 24 communicates with the opening within the body for enabling the contents of the apparatus 10 to be readily removed therefrom. A handle 25 is disposed at the front of the body to facilitate pouring from the pour spout 24.

Figure 3:
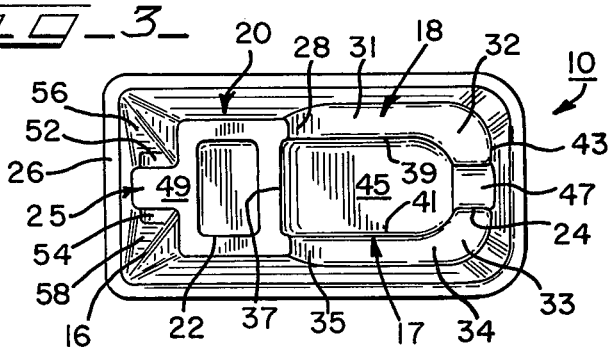
FIG. 3 is a plan view of the apparatus of FIG. 1.
Figure 4:
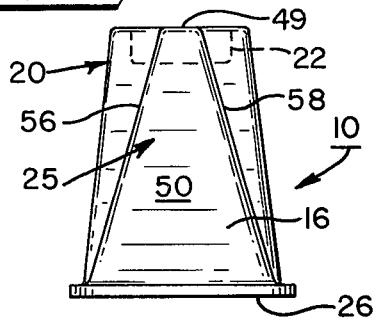
FIG. 4 is a front elevational view of the apparatus of FIG. 1.
Figure 5:
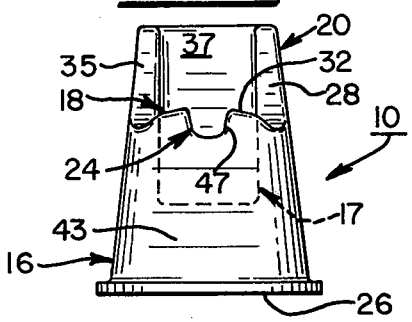
FIG. 5 is a rear elevational view of the apparatus of FIG. 1.

Considering now the body in greater detail with particular reference to FIGS. 1, 3 and 5 of the drawings, the body 16 is generally rectangular in shape and is formed of molded plastic material in a one-piece construction. Thus, the apparatus 10 has no moving parts which are subject to malfunction and hence necessitating repair or replacement. Also, there are no rough corners or edges tending to cause injury to the child. An external outwardly extending base flange 26 extends about the periphery of the body 16 to add stability to the apparatus 10. The body is slightly tapered upwardly from the flange 26 as best seen in FIGS. 4 and 5 of the drawings.

Considering now the seat flange 18 in greater detail, the flange 18 includes a generally vertical portion 28 disposed on the right-hand side of the rear face of the pedestal portion 20 and extending downwardly and slightly rearwardly and terminating at a smoothly contoured corner portion 29, which in turn extends to a side portion 31. The generally vertical portion 28 at least partially receives a portion of the user's body, and thus the portion 28 is smooth and flat so as to engage comfortably the child's body. As best seen in FIG. 2 of the drawings, the side portion 31 extends longitudinally rearwardly and rises gradually upwardly to provide a gently downwardly, from rear to front, seating surface, which is of substantial width so as to help support comfortably the child 12.

The rear end of the side portion 31 terminates at a curved smoothly contoured corner portion 32. The corner portion 32 is slightly wider than the side portion 31 and is disposed at a higher elevation than the side portion to cause the user to slide forwardly therefrom into a rest position in engagement with the pedestal portion 20. A larger size child could be at least partially seated thereon, and in this manner the apparatus 10 is adapted to accommodate comfortably various different size children. The corner portion 32 extends to and terminates at the pouring spout 24. A corner portion 33, similar to the corner portion 32, extends from the other side of the pour spout 24 to a longitudinally extending side portion 34 at the left side of the apparatus 10 in a parallel spaced-apart manner relative to the side flange portion 31. The side flange portion 34 is similar to the side flange portion 31 and slopes downwardly from the rear thereof and terminates at its front end at a generally vertically inclined portion 35. The portion 35 is similar to the portion 28 and extends in a parallel spaced-apart manner relative thereto, extending downwardly and slightly rearwardly from the upper edge of the pedestal portion 20 to the side portion 34 in a smoothly contoured manner.

A vertically extending recess 37 is disposed in the rear face of the pedestal portion 20 between the two generally vertical portions 28 and 35 of the seat flange 18 to communicate with the opening 17, thus serving as a splash guard. The recess extends from the upper edge of the pedestal portion 20 downwardly therefrom into communication with the opening 17.

The opening 17 is defined by the pedestal portion 20, a right side wall 39 having the side flange portion 31 defining its upper edge, a left side wall 41 having the flange portion 34 defining its upper edge, a rear wall 43 in which is disposed the pour spout 24, and a bottom wall 45. The recess 37 in the pedestal extends downwardly to the bottom wall 45 to serve as a guide. As best seen in FIG. 5 of the drawings, the pour spout 24 is in the form of a downwardly extending indentation in the form of a notch or opening 47 communicating with the opening or recess 17. The notch or opening 47 extends from the upper surface of the wall 43 downwardly to a position opposite the positions where the horizontal flange portions 31 and 34 meet the respective generally vertical portions 28 and 35 of the flange 18. The notch or opening 47 is centrally disposed in alignment with the handle 25 at the front end of the body 16.

As best seen in FIG. 4 of the drawings, the handle 25 is integrally connected to and projecting forwardly from the front face of the pedestal portion 20. The handle 25 includes a flat upper surface integrally formed with the upper surface of the pedestal portion 20 and extends downwardly therefrom in an outwardly tapered manner terminating at the base flange 26.

As best seen in FIG. 4 of the drawings, the handle 25 has a flat rear face 50 which is in the shape of a parallelogram. A pair of finger holds or recesses 52 and 54 are disposed in the upper portions of the respective opposite triangularly shaped side walls 56 and 58 and extend downwardly from the upper surface 49. The recesses 52 and 54 enable a person to grasp the handle 25 on either sides thereof with the fingers and thumb of one hand. In this manner, the apparatus 10 can be conveniently picked up and carried by the handle 25, and then tilted or tipped upwardly from the front to the rear thereof to empty the contents of the opening 17 via the pour spout 24.

The smoothly rounded contours of the plastic apparatus 10 facilitates cleaning thereof.

The inclined side flanges 28 and 34 enable the user to sit thereon either facing forwardly as indicated in FIG. 2 of the drawings, or facing rearwardly, thereby adding appeal to the use of the apparatus 10 by a small child.

While the present invention has been described in connection with the particular embodiment thereof, it will be understood that many changes and modifications of this invention may be made by those skilled in the art without departing from the true spirit and scope thereof. For example, other types and kinds of materials may be used for the body 16, such as molded rubber material. Accordingly, the appended claims are intended to cover all such changes and modifications as fall within the true spirit and scope of the present invention.

What is claimed is:

1. A child's toilet apparatus comprising a body having an axis of elongation and a base defining a first plane adapted to rest upon a horizontal surface, said body having a pedestal portion at one end extending from the first plane to a first surface disposed in a second plane parallel to the first plane and a receptacle portion at the other end extending from the first plane to a second surface disposed in a third plane parallel to the first plane, said third plane being disposed between the first and second planes, the second surface being provided with a recess extending therein to form a receptacle portion, said receptacle having spaced opposite walls generally parallel to the axis of elongation of the body extending between the base and the second surface, whereby the second surface forms seat portions on opposite sides of the receptacle for supporting the child, the pedestal portion extending from the receptacle portion and having spaced opposite sides generally parallel to the axis of elongation of the body extending between the base and the first surface, the sides of the pedestal portion being spaced from each other by a distance less than the distance between the walls of the receptacle portion to permit the child to comfortably position its legs on opposite sides of the pedestal portion with its feet resting on the horizontal surface while sitting on the second surface of the receptacle portion, the first surface being above the second surface to provide a convenient position for the hands of the child and the pedestal portion having a third surface extending between the first and second surfaces confronting the recess forming a splash guard; and further including a groove disposed in the second surface extending from the receptacle on the side thereof opposite the pedestal portion to form a pouring spout; and further including handle means disposed on the pedestal portion of said body to facilitate pouring operations; and wherein said handle means is in the form of an outwardly projecting flange on said pedestal portion having a pair of finger hold recesses on opposite sides thereof; and further including a recess in the upper surface of said pedestal portion for storing and supporting articles of amusement; and wherein said flange includes a pair of side parallel spaced apart portions extending from said pedestal portion rearwardly and inclined gradually upwardly therefrom.

2. A child's toilet apparatus according to claim 1 wherein said receptacle portion includes a pair of side parallel spaced-apart seat portions extending from said pedestal rearwardly and inclined gradually upwardly therefrom, said receptacle portion including a pair of generally vertical flange portions on the rear face of said pedestal portion extending to the pair of side portions, and a pair of corner portions extending between the rear end portions of the side portions and the pour spout.

3. A child's toilet apparatus according to claim 1, wherein said apparatus is a one-piece construction and is composed of thermoplastic material, said body including an outwardly extending flange forming the base thereof and is tapered inwardly and upwardly therefrom.

4. A child's toilet apparatus comprising the combination of claim 1 wherein the portion of the second surface adjacent to the pedestal portion is disposed closer to the first plane than other portions of the second surface, and the distance between the second surface and the first plane increases as the distance from the pedestal portion increases, whereby larger children sit on the second surface on portions more remote from the pedestal portion than smaller children to provide a higher seat for larger children.

* * * * *